US009976794B2

(12) United States Patent
Sexton et al.

(10) Patent No.: US 9,976,794 B2
(45) Date of Patent: May 22, 2018

(54) CHEST WITH ACCESS DOORS

(71) Applicant: Electrolux Home Products, Inc., Charlotte, NC (US)

(72) Inventors: Terry Lynn Sexton, Anderson, SC (US); David Simoni, Anderson, SC (US); Andrew Dale Brown, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 326 days.

(21) Appl. No.: 14/679,276

(22) Filed: Apr. 6, 2015

(65) Prior Publication Data

US 2016/0290702 A1 Oct. 6, 2016

(51) Int. Cl.

| | |
|---|---|
| ***F25D 11/00*** | (2006.01) |
| ***F25D 19/00*** | (2006.01) |
| ***F25D 3/08*** | (2006.01) |
| ***F25D 23/02*** | (2006.01) |

(52) U.S. Cl.
CPC ..... *F25D 23/026* (2013.01)

(58) Field of Classification Search
CPC ..... F25D 23/026; F25D 23/02; F25D 3/08; F25D 3/06; F25D 3/02; F25D 2331/804; F25D 2400/16
USPC ..... 62/440, 449, 457.1, 457.7
See application file for complete search history.

(56) References Cited

U.S. PATENT DOCUMENTS

| | | | | |
|---|---|---|---|---|
| 2,365,231 | A | 12/1944 | Wegman | |
| 2,414,061 | A | 1/1947 | Richard et al. | |
| 3,979,007 | A * | 9/1976 | Thornbloom, Jr. .... | A45C 11/20 190/12 R |
| 4,759,193 | A | 7/1988 | Dehring | |
| 6,176,499 | B1 * | 1/2001 | Conrado ..... | A45C 5/14 280/47.26 |
| 7,797,963 | B2 | 9/2010 | Barone et al. | |
| 2005/0046319 | A1 * | 3/2005 | Chekal ..... | F25D 11/02 312/401 |
| 2008/0209812 | A1 | 9/2008 | Lancry et al. | |
| 2011/0000404 | A1 * | 1/2011 | Lauther ..... | A47B 5/06 108/35 |
| 2012/0211499 | A1 * | 8/2012 | Clement ..... | A01K 97/20 220/592.2 |

(Continued)

FOREIGN PATENT DOCUMENTS

| | | |
|---|---|---|
| EP | 1845321 | 10/2007 |

*Primary Examiner* — Frantz Jules
*Assistant Examiner* — Joseph Trpisovsky
(74) *Attorney, Agent, or Firm* — Pearne & Gordon LLP

(57) ABSTRACT

A chest, which can comprise a refrigerated chest such as a freezer for example, includes an opening at the top of the chest through which access can be had to a chest interior. The opening is arranged substantially horizontally when the chest is maintained in its normal operational state. One or more doors mounted to the chest at the opening at the top of the chest are selectively movable between a position closing off the entire opening at the top of the chest and a position opening up the opening, including a horizontal position, thereby providing access to the refrigerated chest interior through the opening. The one or more doors can comprise two equal-sized doors. A respective door support can be provided outside the chest interior for each of the one or more doors at which a door of the one or more doors is supported in a horizontal position.

17 Claims, 2 Drawing Sheets

(56) References Cited

U.S. PATENT DOCUMENTS

2014/0077467 A1* 3/2014 Galante ..... B62B 1/12
280/35

* cited by examiner

CHEST WITH ACCESS DOORS

FIELD OF THE INVENTION

The present invention relates, in general, to storage chests and, in particular, to refrigerated storage chests, including freezers.

BACKGROUND OF THE INVENTION

Storage units of many types—including refrigerated storage units such as freezers for example—are known in the art. In certain instances, the storage units can comprise chests that are provided with doors or lids—in some cases multiple doors or lids—at the tops of the chests through which access may be had to the interiors of the chests.

BRIEF SUMMARY OF THE INVENTION

The following presents a simplified summary of the invention in order to provide a basic understanding of some aspects of the invention. The summary does not comprise an extensive overview of the invention nor is the summary intended to either identify key or critical elements of the invention or delineate the scope of the invention. The sole purpose of the summary is to present certain concepts of the invention in a simplified form as a prelude to the more detailed description that is presented later herein.

According to one aspect, a refrigerated chest can include a refrigerated chest interior and an opening at the top of the refrigerated chest that provides access to the refrigerated chest interior. The opening can be arranged substantially horizontally when the refrigerated chest is maintained in its normal operational state. The refrigerated chest also can include a pair of equal-sized doors that are arranged at the opening at the top of the refrigerated chest. The equal-sized doors can be selectively movable between a position closing off equal portions of the opening at the top of the refrigerated chest and a position opening up the equal portions of the opening at the top of the refrigerated chest. In a particular embodiment, the pair of equal-sized doors can be mounted for pivotal movement between positions selectively closing off and opening up equal portions of the opening at the top of the refrigerated chest.

According to another aspect, the opening at the top of the refrigerated chest can include an opening first end and an opening second end arranged opposite the opening first end. The pair of equal-sized doors can comprise a first door, that includes a first door first side and a first door second side arranged opposite the first door first side, and a second door, that includes a second door first side and a second door second side arranged opposite the second door first side. The equal portions of the opening at the top of the refrigerated chest can comprise a first portion of the opening at the top of the refrigerated chest and a second portion of the opening at the top of the refrigerated chest. The first door first side can be secured at the opening first end for pivotal movement of the first door between a position closing off the first portion of the opening at the top of the refrigerated chest and a position opening up the first portion of the opening at the top of the refrigerated chest. Further, the second door first side can be secured at the opening second end for pivotal movement of the second door between a position closing off the second portion of the opening at the top of the refrigerated chest and a position opening up the second portion of the opening at the top of the refrigerated chest.

According to a further aspect of the invention, a refrigerated chest can include a refrigerated chest interior and an opening at the top of the refrigerated chest through which access can be had to the refrigerated chest interior. The opening can be arranged substantially horizontally when the refrigerated chest is maintained in its normal operational state. One or more doors can be mounted to the refrigerated chest at the opening at the top of the refrigerated chest and be selectively movable between a position closing off the entire opening at the top of the refrigerated chest and a horizontal position providing access to the refrigerated chest interior through the opening at the top of the refrigerated chest. A respective door support can be provided outside the refrigerated chest interior for each of the one or more doors at which a door of the one or more doors is supported in a horizontal position.

According an additional aspect, each door support can be mounted at the refrigerated chest for pivotal movement of the door support between the position supporting one of the one or more doors in the horizontal position and a position withdrawn from the position supporting one of the one or more doors in the horizontal position.

According to yet another aspect, with a refrigerated chest having a respective door support for each of one or more doors, the one or more doors can comprise a first door and a second door. The first door can be mounted to the refrigerated chest at the opening at the top of the refrigerated chest for pivotal movement of the first door between a position closing off a first portion of the opening at the top of the refrigerated chest and a horizontal position providing access to the refrigerated chest interior through the first portion of the opening at the top of the refrigerated chest. The second door can be mounted to the refrigerated chest at the opening at the top of the refrigerated chest for pivotal movement of the second door between a position closing off a second portion of the opening at the top of the refrigerated chest and a horizontal position providing access to the refrigerated chest interior through the second portion of the opening at the top of the refrigerated chest. A first door support can be provided outside the refrigerated chest interior at which the first door is supported in a horizontal position, and a second door support can be provided outside the refrigerated chest interior at which the second door is supported in a horizontal position. With respect to a particular embodiment, the first door of the refrigerated chest can be of equal size to the second door, and the first portion of the opening at the top of the refrigerated chest can be of equal size to the second portion of the opening at the top of the refrigerated chest.

According to yet a further aspect, the first door can include a first door first side at which the first door is pivotally mounted to the refrigeration chest and a first door second side, arranged opposite the first door first side, that passes through an angle of 180 degrees when the first door is opened from the position closing off the first portion of the opening at the top of the refrigeration chest to the horizontal position at which the first door is supported in the horizontal position by the first door support outside the refrigerated chest interior. Also the second door can include a second door first side at which the second door is pivotally mounted to the refrigeration chest and a second door second side, arranged opposite the second door first side, that passes through an angle of 180 degrees when the second door is opened from the position closing off the second portion of the opening at the top of the refrigeration chest to the horizontal position at which the second door is supported in the horizontal position by the second door support outside the refrigerated chest interior.

According to yet an additional aspect, with all the refrigerated chests described above, one of the first door second side and the second door second side can include a heated flipper mullion. The other of the first door second side and the second door second side can include a gasket that engages the heated flipper mullion when the first door and the second door are in positions closing off the first portion of the opening at the top of the refrigeration chest and the second portion of the opening at the top of the refrigeration chest, respectively. As a result, a space between the first door free side and the second door free side is closed. Also with respect to all the refrigerated chests described above, the refrigerated chests can comprise freezers.

According to still another aspect, a chest can include: an upstanding front wall having a front wall first end and a front wall second end; an upstanding rear wall located opposite the upstanding front wall and having a rear wall first end and a rear wall second end; a first upstanding side wall joining the upstanding front wall first end and the upstanding rear wall first end; a second upstanding side wall joining the upstanding front wall second end and the upstanding rear wall second end; and a bottom wall joined to the upstanding front wall, the upstanding rear wall, the first upstanding side wall and the second upstanding side wall and closing off the bottom of the chest. The chest also can include a chest interior and an opening at the top of the chest through which access can be had to the chest interior. The opening can be arranged substantially horizontally when the chest is maintained in its normal operational state. A first door can be mounted to the first upstanding side wall at the opening at the top of the chest for pivotal movement of the first door between a position closing off a first portion of the opening at the top of the chest and a horizontal position removed from the first portion of the opening at the top of the chest, thereby providing access to the chest interior through the first portion of the opening at the top of the chest. A second door can be mounted to the second upstanding wall at the opening at the top of the chest for pivotal movement of the second door between a position closing off a second portion of the opening at the top of the chest and a horizontal position removed from the second portion of the opening at the top of the chest, thereby providing access to the chest interior through the second portion of the opening at the top of the chest. The second portion of the opening at the top of the chest can be of equal size to the first portion of the opening at the top of the chest. A first door support can be mounted at the first upstanding side wall for pivotal movement of the first door support between a horizontal position at which the first door is supported in the horizontal position outside the chest interior at the first door support and a position withdrawn from the horizontal position. A second door support can be mounted at the second upstanding side wall for pivotal movement of the second door support between a horizontal position at which the second door is supported in the horizontal position outside the chest interior at the second door support and a position withdrawn from the horizontal position.

According to still a further aspect, with the chest described in the immediately preceding paragraph, the first door can include a first door first side at which the first door is pivotally mounted to the first upstanding side wall at the opening at the top of the chest and a first door second side, arranged opposite the first door first side, that passes through an angle of 180 degrees when the first door is opened from the position closing off the first portion of the opening at the top of the chest to the horizontal position at which the first door is supported in a horizontal position outside the chest interior by the first door support. Also, the second door can include a second door first side at which the second door is pivotally mounted to the second upstanding side wall at the opening at the top of the chest and a second door second side, arranged opposite the second door first side, that passes through an angle of 180 degrees when the second door is opened from the position closing off the second portion of the opening at the top of the chest to the horizontal position at which the second door is supported in a horizontal position outside the chest interior by the second door support.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
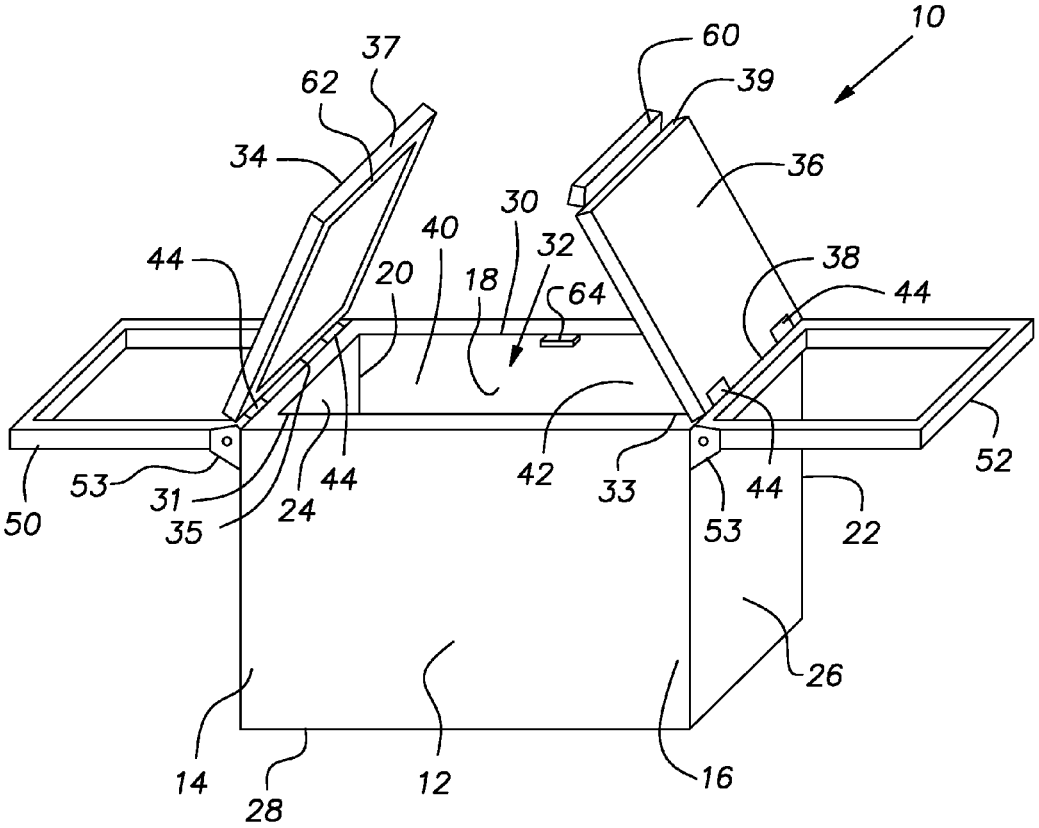
FIG. 1 is a perspective view of a first embodiment of the invention.

The present invention will now be described with reference to the drawings, wherein like reference numerals are used to refer to like elements throughout. It is to be appreciated that the several drawings are not necessarily drawn to scale from one figure to another or within a given figure. The sizes of the components are somewhat arbitrarily drawn in order to facilitate an understanding of the figures. In the following description, numerous specific details are set forth in order to provide a thorough understanding of the present invention, but it can be possible in certain instances to practice the present invention without those specific details.

Referring first to FIG. 1, there is illustrated a first embodiment of the present invention comprising a refrigerated chest, indicated generally at 10. The chest includes: an upstanding front wall 12 having a front wall first end 14 and a front wall second end 16; an upstanding rear wall 18 located opposite the upstanding front wall 12 and having a rear wall first end 20 and a rear wall second end 22; a first upstanding side wall 24 joining the upstanding front wall first end 14 and the upstanding rear wall first end 20; a second upstanding side wall 26 joining the upstanding front wall second end 16 and the upstanding rear wall second end 22; and a bottom wall 28 joined to the upstanding front wall 12, the upstanding rear wall 18, the first upstanding side wall 24 and the second upstanding side wall 26 and closing off the bottom of the refrigerated chest 10. Although the present invention is described with particular reference to refrigerated chests, as illustrated in the embodiment of the figures of the drawings, the invention is applicable to chests in general that include chest interiors, openings at the tops of the chests and doors or lids for closing off and opening up the openings at the tops of the chests so that access can be had to the chest interiors.

In the example embodiment of FIG. 1, the refrigerated chest 10, which can comprise a freezer, includes an opening 30 at the top of the refrigerated chest 10 through which access can be had to a refrigerated chest interior, indicated generally at 32. The opening 30 includes an opening first end 31 and an opening second end 33 arranged opposite the opening first end 31. One or more doors are mounted to the refrigerated chest 10 at the opening 30 at the top of the refrigerated chest 10. In the example embodiment of FIG. 1, the one or more doors comprise two doors that include a first door 34 that is mounted to the first upstanding side wall 24 at the opening 30 at the top of the refrigerated chest 10 and a second door 36 that is mounted to the second upstanding wall 26 at the opening 30 at the top of the refrigerated chest 10.

Figure 2:
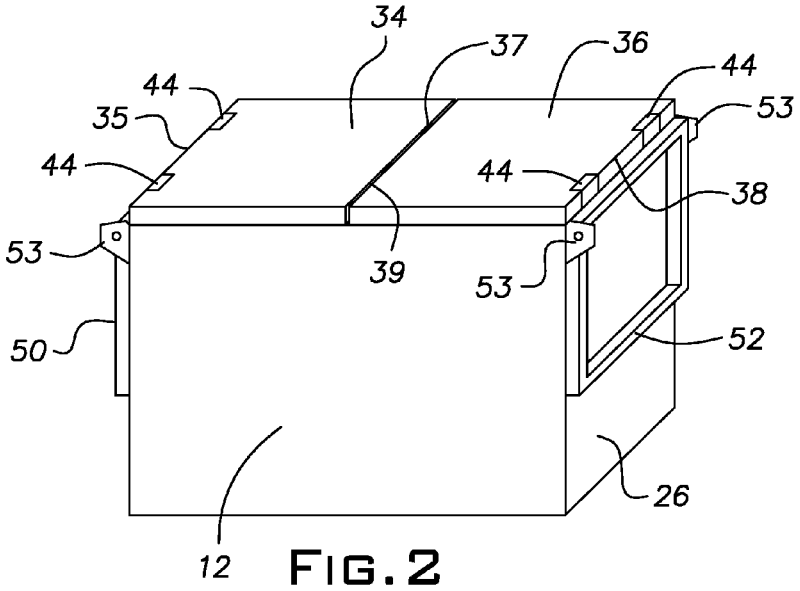
FIG. 2 is a perspective view of the embodiment of FIG. 1 shown in an alternative operational state.

The first door 34 includes a first door first side 35 and a first door second side 37 arranged opposite the first door first side 35. The second door 36 includes a second door first side 38 and a second door second side 39. The first door 34 and the second door 36 are selectively movable between a position closing off the entire opening 30 at the top of the refrigerated chest 10, as shown in FIG. 2, and a position opening up the opening 30 at the top of the refrigerated chest, as shown in FIG. 1 for example, thereby providing access to the refrigerated chest interior 32 through the opening 30. More specifically, the first door first side 35 is secured at the first upstanding side wall 24 at the opening first end 31 for pivotal movement between a position closing off a first portion 40 of the opening 30 and a position opening up the first portion 40 of the opening 30. Similarly, the second door first side 38 is secured at the second upstanding wall 26 at the opening second end 33 for pivotal movement between a position closing off a second portion 42 of the opening 30 and a position opening up the second portion 42 of the opening 30. The pivotal movements of the first door 34 and the second door 36 are established by means of hinges 44 which secure the first door and the second door at the first upstanding side wall 24 and the second upstanding side wall 26, respectively.

In FIG. 1, the first door 34 and the second door 36 are shown in a partially open position. However, both doors can be opened fully to horizontal positions as is described below.

In the example embodiment of FIG. 1, the first door 34 and the second door 36 are of equal size and thus comprise a pair of equal-sized doors that are arranged at the opening 30 at the top of the refrigerated chest 10. Because of their equal size, and because of their hinged mountings, the first door 34 and the second door 36 are selectively movable between a position closing off equal portions of the opening 30 and a position opening up equal portions of the opening 30. Thus, in this context, the first portion 40 of the opening 30 is of equal size to the second portion 42 of the opening 30 so that the pair of equal-sized doors, comprising the first door 34 and the second door 36, are pivotally movable between selectively closing off and opening up equal portions of the opening 30.

According to the embodiments of the invention illustrated in the figures, the first door 34 and the second door 36 are pivotally mounted to the refrigerated chest 10 so that they are selectively movable between a position closing off the entire opening 30, as shown in FIG. 2, and a horizontal position opening up the interior of the refrigerated chest 32, thereby providing complete access to the interior of the refrigerated chest and providing a working space as is discussed below. In their latter functional configuration, it can be of benefit to provide supports for the first door 34 and the second door 36. Thus, a respective door support can be provided at the refrigerated chest 10 outside the refrigerated chest interior 32 for each of the one or more doors. At each respective door support, a door of the one or more doors can be supported in a horizontal position. More specifically, as shown in FIG. 1, a first door support 50 is provided outside the refrigerated chest interior 32 at which the first door 34 is supported in a horizontal position when the first door completely opens up the portion of the opening 30 which it is designed to close off, i.e., portion 40. Similarly, a second door support 52 is provided outside the refrigerated chest interior 32 at which the second door 36 is supported in a horizontal position when the second door completely opens up the portion of the opening 30 that it is designed to close off, i.e., portion 42.

It will be understood from the foregoing description that with respect to the example embodiment of FIG. 1, the first door 34 is mounted to the refrigerated chest 10 at the opening 30 for pivotal movement between a position closing off the first portion 40 of the opening 30 and a horizontal position, removed from the first portion 40 of the opening 18, thereby providing access to the refrigerated chest interior 32 through the first portion 40 of the opening 30. Similarly, the second door 36 is mounted to the refrigerated chest 10 at the opening 30 for pivotal movement between a position closing off the second portion 42 of the opening 30 and a horizontal position, removed from the second portion 42 of the opening 30, thereby providing access to the refrigerated chest interior 32 through the second portion 42 of the opening 30.

As described, the first door 34 includes the first door second side 37 that is arranged opposite the first door first side 35, and the first door second side 37 passes through an angle of 180 degrees when the first door 34 is opened from the position closing off the first portion 40 of the opening 30 at the top of the refrigerated chest 10 to the horizontal position at which the first door 34 is supported in that horizontal position outside the refrigerated chest interior 32 by a first door support 50. Similarly, the second door 36 includes the second door second side 39 that is arranged opposite the second door first side 38, and the second door second side 39 passes through an angle of 180 degrees when the second door 36 is opened from the position closing off the second portion 42 of the opening 30 at the top of the refrigerated chest 10 to the horizontal position at which the second door 36 is supported in that horizontal position outside the refrigerated chest interior 32 by a second door support 52.

The first door support 50 is mounted at the first upstanding wall 24 for pivotal movement between the horizontal position shown in FIG. 1, at which the first door 34 can be supported in the horizontal position outside the refrigerated chest interior 32 at the first door support 50, and a position withdrawn from that horizontal position, such as at the side of the first upstanding side wall 24 as shown in FIG. 2. Similarly, the second door support 52 is mounted at the second upstanding wall 26 for pivotal movement between the horizontal position shown in FIG. 1, at which the second door 36 can be supported in the horizontal position outside the refrigerated chest interior 32 at the second door support 52, and a position withdrawn from that horizontal position, such as at the side of the second upstanding side wall 26 as shown in FIG. 2.

Figure 3:
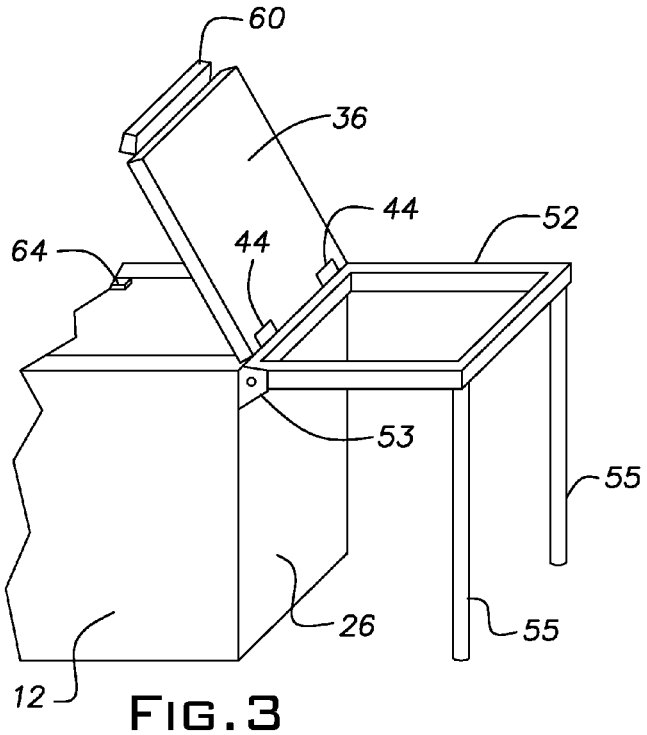
FIG. 3 is a partial perspective view of a second embodiment of the invention.

The functioning of each of the first door support 50 and the second door support 52, as described above, from a horizontal position supporting the first door 34 and the second door 36, respectively, to a position at the side of the first upstanding wall 24 and the second upstanding wall 26, respectively, is accomplished through the use of the hinges 44 which can comprise locking hinges for example. The operation of locking hinges is familiar to those having ordinary skill in the art and is not described here. Suffice it to say that the hinges 44 will lock in place when the first door support 50 is in the horizontal position and when the second door support 52 is in the horizontal position. The hinges 44 are provided with a release feature, also as is familiar to those having ordinary skill in the art, so that the first door support 50 and the second door support 52 can be lowered to their respective positions shown in FIG. 2. The supporting function of the first door support 50 and the second door support 52 can be augmented by, for example, providing leg supports, such as shown at 55 in FIG. 3, that engage the end of the door support that is distal from the attachment point of the door support to the refrigerated chest and rest on the same surface as the refrigerated chest. Respective leg supports 55 can be pivotally secured to the first door support 50 and the second door support 52 so that the leg supports can be folded beneath the door supports when the door supports are folded down at respective sides of the refrigeration chest 10.

The first door 34 and the second door 36 are constructed so that when they are in a completely closed position, the first door second side 37 and the second door second side 39 do not abut one another. Rather, one of the first door second side 37 and the second door second side 39 includes a flipper mullion pivotally secured thereto, and the other of the first door second side 37 and the second door second side 39 includes a gasket configured to engage the flipper mullion when the first door 34 and the second door 36 are in positions closing off the first portion 40 of the opening 30 and the second portion 42 of the opening 30, respectively. Thereby, a space formed between the first door second side 37 and the second door second side 39 when the doors are completely closed is closed off. In the embodiment of the figures in the drawings, a flipper mullion 60 is secured to second door second side 39 and a gasket 62 is included at the first door second side 37. A mullion guide 64 is provided to assist the pivoting of the mullion to a closing position when the first door 34 and the second door 36 are closed. Flipper mullions of this type that are provided for upright household refrigerators are known to those skilled in the art. An example of such a flipper mullion is described in U.S. Pat. No. 8,511,106, the disclosure of which is fully incorporated herein for all purposes. The flipper mullion can be heated, a feature also familiar to those skilled in the art in connection with upright household refrigerators.

By providing a chest as described, the doors or lids which can be moved to a horizontal position the ability of a user to deal with, for example, loading, unloading and rearranging tasks at the chest is enhanced. Thus, the overturned doors resting in a horizontal position on the door supports provide a user with working spaces that facilitate the undertaking of those tasks.

The invention has been described above using specific examples; however, it will be understood by those having ordinary skill in the art that various alternatives may be used and equivalents may be substituted for elements or steps described herein without deviating from the scope of the invention. For example, although the invention has been particularly described with reference to a refrigeration appliance that can comprise a freezer for example, the invention also can comprise other types of refrigeration appliances such as insulated chests including insulated chests that can variously contain ice for cooling or the interior of which can be cooled by other means for preserving articles maintained at the interiors of the insulated chests. Indeed, the chest need not be refrigerated, and the principles of the invention can be applied to chests in general. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A refrigerated chest including:

a refrigerated chest interior;

an opening at the top of the refrigerated chest providing access to the refrigerated chest interior, the opening being arranged substantially horizontally when the refrigerated chest is maintained in its normal operational state;

a pair of equal-sized doors arranged at the opening at the top of the refrigerated chest, the equal-sized doors being selectively movable between a position closing off equal portions of the opening at the top of the refrigerated chest and a position opening up the equal portions of the opening at the top of the refrigerated chest, the pair of equal-sized doors comprises a first door, including a first door first side and a first door second side arranged opposite the first door first side, and a second door, including a second door first side and a second door second side arranged opposite the second door first side, and wherein one of the first door second side and the second door second side includes a heated flipper mullion secured thereto and the other of the first door second side and the second door second side includes a gasket configured to engage the flipper mullion when the first door and the second door are in positions closing off equal portions of the opening at the top of the chest, respectively, so as to close off a space between the first door second side the second door second side, a first door support mounted to a first wall of the chest for pivotal movement of the first door support between a horizontal position at which the first door is supported by the first door support in the horizontal position outside the chest interior and a vertical position adjacent the first wall of the chest; and a second door support mounted to a second wall of the chest for pivotal movement of the second door support between a horizontal position at which the second door is supported by the second door support in the horizontal position outside the chest interior and a vertical position adjacent the second wall of the chest.

2. The refrigerated chest of claim 1 wherein the pair of equal-sized doors are pivotally movable between selectively closing off and opening up equal portions of the opening at the top of the refrigerated chest.

3. The refrigerated chest of claim 2 wherein:

the opening at the top of the refrigerated chest includes an opening first end and an opening second end arranged opposite the opening first end;

the equal portions of the opening at the top of the refrigerated chest comprise a first portion of the opening at the top of the refrigerated chest and a second portion of the opening at the top of the refrigerated chest;

the first door first side is secured at the opening first end for pivotal movement of the first door between a position closing off the first portion of the opening at the top of the refrigerated chest and a position opening up the first portion of the opening at the top of the refrigerated chest; and the second door first side is secured at the opening second end for pivotal movement of the second door between a position closing off the second portion of the opening at the top of the refrigerated chest and a position opening up the second portion of the opening at the top of the refrigerated chest.

4. The refrigerated chest of claim 3 wherein the refrigerated chest comprises a freezer.

5. A refrigerated chest including:

a refrigerated chest interior;

an opening at the top of the refrigerated chest through which access can be had to the refrigerated chest interior, the opening being arranged substantially horizontally when the refrigerated chest is maintained in its normal operational state;

a first door and a second door mounted to the refrigerated chest at the opening at the top of the refrigerated chest and selectively movable between a position closing off the entire opening at the top of the refrigerated chest and a horizontal position providing access to the refrigerated chest interior through the opening at the top of the refrigerated chest; and a respective door support provided outside the refrigerated chest interior for each of the one or more doors at which a door of the one or more doors is supported in a horizontal position wherein one of a first door first side and a second door first side includes a heated flipper mullion and the other of the first door first side and the second door first side includes a gasket that engages the heated flipper mullion when the first door and the second door are in positions closing off a first portion of the opening at the top of the refrigeration chest and a second portion of the opening at the top of the refrigeration chest, respectively, whereby a space between the first door second side and the second door second side is closed, and wherein each door support is mounted to a respective wall of the chest for pivotal movement of the door support between the position supporting one of the one or more doors in the horizontal position and a vertical position adjacent the respective wall of the chest.

6. The refrigerated chest of claim 5, wherein the refrigerated chest comprises a freezer.

7. The refrigerated chest of claim 5 wherein:

the first door is mounted to the refrigerated chest at the opening at the top of the refrigerated chest for pivotal movement of the first door between a position closing off the first portion of the opening at the top of the refrigerated chest and a horizontal position providing access to the refrigerated chest interior through the first portion of the opening at the top of the refrigerated chest;

the second door is mounted to the refrigerated chest at the opening at the top of the refrigerated chest for pivotal movement of the second door between a position closing off the second portion of the opening at the top of the refrigerated chest and a horizontal position providing access to the refrigerated chest interior through the second portion of the opening at the top of the refrigerated chest;

a first door support is provided outside the refrigerated chest interior at which the first door is supported in a horizontal position;

and a second door support is provided outside the refrigerated chest interior at which the second door is supported in a horizontal position.

8. The refrigerated chest of claim 7 wherein:

the first door is of equal size to the second door; and the first portion of the opening at the top of the refrigerated chest is of equal size to the second portion of the opening at the top of the refrigerated chest.

9. The refrigerated chest of claim 8 wherein:

the first door first side of the first door is pivotally mounted to the refrigeration chest and a first door second side of the first door, arranged opposite the first door first side, passes through an angle of 180 degrees when the first door is opened from the position closing off the first portion of the opening at the top of the refrigeration chest to the horizontal position at which the first door is supported in the horizontal position by the first door support outside the refrigerated chest interior; and the second door first side of the second door is pivotally mounted to the refrigeration chest and a second door second side of the second door, arranged opposite the second door first side, passes through an angle of 180 degrees when the second door is opened from the position closing off the second portion of the opening at the top of the refrigeration chest to the horizontal position at which the second door is supported in the horizontal position by the second door support outside the refrigerated chest interior.

10. The refrigerated chest of claim 9, wherein the refrigerated chest comprises a freezer.

11. The refrigerated chest of claim 5 wherein each door support is mounted at the refrigerated chest for pivotal movement of the door support between the position supporting one of the one or more doors in the horizontal position and a position withdrawn from the position supporting one of the one or more doors in the horizontal position.

12. The refrigerated chest of claim 11 wherein:

the first door is mounted to the refrigerated chest at the opening at the top of the refrigerated chest for pivotal movement of the first door between a position closing off a first portion of the opening at the top of the refrigerated chest and a horizontal position providing access to the refrigerated chest interior through the first portion of the opening at the top of the refrigerated chest;

the second door is mounted to the refrigerated chest at the opening at the top of the refrigerated chest for pivotal movement of the second door between a position closing off a second portion of the opening at the top of the refrigerated chest and a horizontal position providing access to the refrigerated chest interior through the second portion of the opening at the top of the refrigerated chest;

a first door support is provided outside the refrigerated chest interior at which the first door is supported in a horizontal position;

and a second door support is provided outside the refrigerated chest interior at which the second door is supported in a horizontal position.

13. The refrigerated chest of claim 12 wherein:

the first door is of equal size to the second door; and the first portion of the opening at the top of the refrigerated chest is of equal size to the second portion of the opening at the top of the refrigerated chest.

14. The refrigerated chest of claim 13 wherein:

the first door includes a first door first side at which the first door is pivotally mounted to the refrigeration chest and a first door second side, arranged opposite the first door first side, that passes through an angle of 180 degrees when the first door is opened from the position closing off the first portion of the opening at the top of the refrigeration chest to the horizontal position at which the first door is supported in a horizontal position by the first door support outside the refrigerated chest interior; and the second door includes a second door first side at which the second door is pivotally mounted to the refrigeration chest and a second door second side, arranged opposite the second door first side, that passes through an angle of 180 degrees when the second door is opened from the position closing off the second portion of the opening at the top of the refrigeration chest to the horizontal position at which the second door is supported in a horizontal position by the second door support outside the refrigerated chest interior.

15. The refrigerated chest of claim 14, wherein the refrigerated chest comprises a freezer.

16. A chest including:

an upstanding front wall having a front wall first end and a front wall second end;

an upstanding rear wall located opposite the upstanding front wall and having a rear wall first end and a rear wall second end;

a first upstanding side wall joining the upstanding front wall first end and the upstanding rear wall first end;

a second upstanding side wall joining the upstanding front wall second end and the upstanding rear wall second end;

a bottom wall joined to the upstanding front wall, the upstanding rear wall, the first upstanding side wall and the second upstanding side wall and closing off the bottom of the chest;

a chest interior;

an opening at the top of the chest through which access can be had to the chest interior, the opening being arranged substantially horizontally when the chest is maintained in its normal operational state;

a first door mounted to the first upstanding side wall at the opening at the top of the chest for pivotal movement of the first door between a position closing off a first portion of the opening at the top of the chest and a horizontal position removed from the first portion of the opening at the top of the chest thereby providing access to the chest interior through the first portion of the opening at the top of the chest;

a second door mounted to the second upstanding wall at the opening at the top of the chest for pivotal movement of the second door between a position closing off a second portion of the opening at the top of the chest and a horizontal position removed from the second portion of the opening at the top of the chest, thereby providing access to the chest interior through the second portion of the opening at the top of the chest, the second portion of the opening at the top of the chest being of equal size to the first portion of the opening at the top of the chest;

a first door support mounted at the first upstanding side wall for pivotal movement of the first door support between a horizontal position at which the first door is supported in the horizontal position outside the chest interior at the first door support and a position withdrawn from the horizontal position; and a second door support mounted at the second upstanding side wall for pivotal movement of the second door support between a horizontal position at which the second door is supported in the horizontal position outside the chest interior at the second door support and a position withdrawn from the horizontal position, wherein one of a first door first side and a second door first side includes a heated flipper mullion and the other of the first door first side and the second door first side includes a gasket that engages the heated flipper mullion when the first door and the second door are in positions closing off a first portion of the opening at the top of the refrigeration chest and a second portion of the opening at the top of the refrigeration chest, respectively, whereby a space between the first door second side and the second door second side is closed, and wherein the position withdrawn from the horizontal position for the first door support is adjacent a side of the first upstanding side wall, and the position withdrawn from the horizontal position for the second door support is adjacent a side of the second upstanding side wall.

17. The chest of claim 16 wherein:

the first door first side of the first door is pivotally mounted to the first upstanding side wall at the opening at the top of the chest and a first door second side, arranged opposite the first door first side, passes through an angle of 180 degrees when the first door is opened from the position closing off the first portion of the opening at the top of the chest to the horizontal position at which the first door is supported in a horizontal position outside the chest interior by the first door support;

the second door first side of the second door is pivotally mounted to the second upstanding side wall at the opening at the top of the refrigeration chest and a second door second side, arranged opposite the second door first side, passes through an angle of 180 degrees when the second door is opened from the position closing off the second portion of the opening at the top of the chest to the horizontal position at which the second door is supported in a horizontal position outside the chest interior by the second door support.

* * * * *